US005586692A

United States Patent [19]

Livengood

[11] Patent Number: 5,586,692

[45] Date of Patent: Dec. 24, 1996

[54] WATER BOTTLE ASSIST DEVICE

[76] Inventor: Rodney C. Livengood, P.O. Box 744, Kittanning, Pa. 16201

[21] Appl. No.: 402,642

[22] Filed: Mar. 13, 1995

[51] Int. Cl.[6] ..... B67D 5/64

[52] U.S. Cl. ..... 222/166; 141/391; 222/185.1; 414/421

[58] Field of Search ..... 222/164, 166, 222/173, 185.1; 141/351, 391; 414/421

[56] References Cited

U.S. PATENT DOCUMENTS

| | | | |
|---|---|---|---|
| 2,319,739 | 5/1943 | Kessler | 158/40 |
| 3,826,408 | 7/1974 | Berndt et al. | 222/166 X |
| 3,868,033 | 2/1975 | Le Duff | 214/707 |
| 3,934,772 | 1/1976 | Brannan | 222/45 AA |
| 4,737,065 | 4/1988 | Ju | 414/490 |
| 4,797,050 | 1/1989 | Habicht | 414/420 |
| 4,834,438 | 5/1989 | Haidet | 294/31.2 |
| 4,972,976 | 11/1990 | Romero | 222/185.1 |
| 5,104,135 | 4/1992 | Sheets | 280/47.19 |
| 5,288,200 | 2/1994 | Burgers et al. | 414/758 |
| 5,379,814 | 1/1995 | Posly | 141/391 X |
| 5,406,996 | 4/1995 | Wagner et al. | 141/391 X |

*Primary Examiner*—Joseph Kaufman
*Attorney, Agent, or Firm*—George C. Atwell

[57] ABSTRACT

An assist device is disclosed for use with a drinking water dispenser of the type utilizing a large inverted water bottle mounted in a recess or reservoir located on the top flat surface of the dispenser. The assist device is used by a person in replacing the water bottle on the dispenser. The assist device includes a base member for resting against one side of the dispenser in a horizontal orientation with respect to the floor supporting the dispenser. The base member includes a recess into which the bottom of the water bottle is set and an elongated support member having an upper end which is secured to the base member and a lower end which rests on the floor when the base member is disposed against the dispenser. The support member spaces the base member from the floor an appropriate distance so that the top rim of the water bottle is adjacent an upper edge of the dispenser. Attachment straps extend from the base member to the dispenser for retaining the base member in close proximity to the dispenser during the process of inverting the water bottle and mounting the bottle in the recess of the dispenser.

4 Claims, 5 Drawing Sheets

WATER BOTTLE ASSIST DEVICE

BACKGROUND OF THE INVENTION

The present invention relates generally to drinking water dispensers and, more particularly, pertains to an assist device for mounting a replacement water bottle on top of a free-standing dispenser.

It is common practice to provide in many office, institutional, and factory locations, a free-standing drinking water dispenser having an inverted, large bottled water reservoir that requires periodic replacement. Typically, the water bottle has a five-gallon capacity. Although heavy glass bottles have been replaced over recent years with plastic containers of the same capacity, a full bottle, even in comparatively lighter plastic, weighs approximately 53 pounds. Removal of an empty bottle from the dispenser and replacing it with a full one requires a manual lifting and inverting operation with respect to the full replacement bottle which is not an easy task for any individual.

The foregoing problem has been recognized in the prior art and one solution offered is disclosed in U.S. Pat. No. 3,653,413 which contemplates eliminating bottle replacement on such a dispenser by utilizing pump apparatus to move a volume of water to the dispenser-mounted bottle from an adjacent source bottle. This approach has not been universally well-received, and manual bottle replacement continues to be the common practice.

The present invention addresses the foregoing problem by the provision of a device which an individual, charged with the responsibility of water bottle replacement on a free-standing dispenser, can utilize to assist in the bottle installation procedure. The device of the invention is simple to operate, inexpensive to manufacture, and easily removable from its operative position when not in use.

SUMMARY OF THE INVENTION

The present invention comprehends an assist device for inverting and mounting in a continuous motion a filled replacement water bottle to an inverted, dispensing position within a reservoir or recess located at the upper end of a drinking water dispenser which is setting on a level surface, such as in an office hallway or on a factory floor.

The assist device comprises a flat base member which includes, for example, a square-shaped or a circular recess for receiving the bottom portion of the water bottle. The water bottle is maintained temporarily in an upright position while setting within the recess of the base. The base member is disposed in a horizontal disposition with respect to the drinking water dispenser and the base member is also spaced from the floor so that the base member can rest or lean against a first sidewall of the dispenser. Thus, the base member rests against a first sidewall of the dispenser and the assist device is maintained in an upright position adjacent the dispenser.

The assist device of the present invention also includes an elongated support member which is secured to the base member at an upper end while the lower end of the support member rests upon the floor. The support member is secured to a first side of the base member while an opposite second side of the base member rests against the first sidewall of the dispenser, thus, the support member is spaced from the dispenser by the width of the base member. Because the support member is elongated, the support member spaces the base member from the floor a fixed distance. For ease of inverting and mounting a full replacement water bottle in the inverted, dispensing position within the dispenser reservoir, the vertical extension or length of the support member should be such that when the base member is resting against the first sidewall and the bottom portion of the replacement water bottle is set within the recess so the replacement water bottle is setting upright on the base member, the rim of the water bottle which flares circumjacently outward from the water bottle neck will be adjacent to the top edge of the dispenser.

Since water bottles and dispensers come in varying heights, the assist device includes an elongated extension member which is secured to the support member adjacent the lower end thereof. The extension member is capable of selective, slidable, reciprocable, linear movement with respect to and against the support member. Selectively adjusting the extension member will increase the length of the support member and will thus alter the distance the base member is spaced from the floor. The selective adjustment of the extension member will allow for the proper positioning of the rim of the replacement water bottle adjacent to the top edge of the dispenser when the water bottle is placed on the base member.

For maintaining the assist device in close proximity to the dispenser during the process of lifting, pivoting, and inverting the assist device in one continuous motion so the water bottle can be placed in an inverted, dispensing position on the dispenser, a retention means is utilized. The retention means preferably includes a pair of elongated straps attached to the side of the base member opposite the side of the base member to which the support member is secured. When the assist device is resting against the first sidewall of the dispenser in the non-use position, the elongated straps will run along and in contact with the first sidewall, across the top flat surface of the dispenser where the reservoir is located and down along the opposite dispenser sidewall a short distance. Attached to the opposite dispenser sidewall will be a pair of spaced-apart, elongated attachment strips which can be, for example, Velcro strips. The ends of the straps have Velcro attached or sewn thereinto, and each strap end will be secured to each respective attachment strip. When the individual commences the process of mounting a replacement water bottle in the recess of the dispenser by first gripping and then pivoting the support member away from the dispenser with the rim using the top edge of the dispenser as a pivot point, the securement of each respective strap end to each respective attachment strip maintains the contact of the water bottle rim with the top edge of the dispenser so that the individual can pivot and invert the replacement water bottle in one continuous motion.

It is an objective of the present invention to provide an assist device which is simply constructed and easy to use by any adult individual.

It is a further objective of the present invention to provide an assist device which is of lightweight construction for ease of handling and storing.

Still another objective of the present invention is to provide an assist device which can accommodate water bottles of varying diameters and shapes.

These together with other objects and advantages which will become subsequently apparent reside in the details of construction and operation as more fully hereinafter described and claimed, reference being had to the accompanying drawings, forming a part hereof, wherein like numerals refer to like parts throughout.

DETAILED DESCRIPTION OF THE PREFERRED EMBODIMENT

Figure 1:
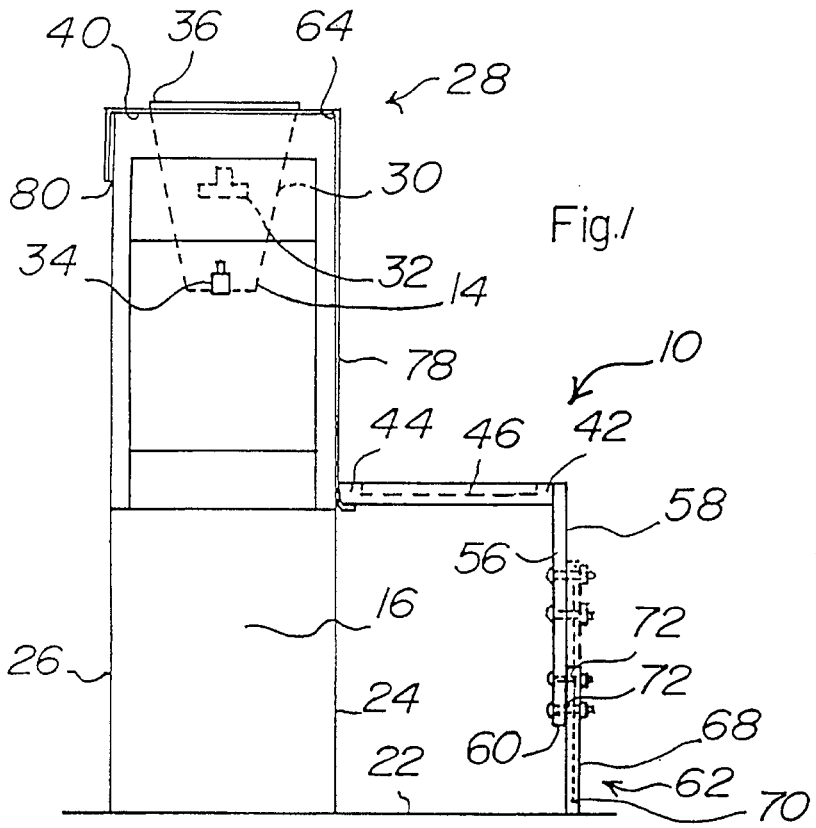
FIG. 1 is a side elevational view of the preferred embodiment of the assist device when it is disposed in the non-use position leaning against the dispenser.

Shown in FIGS. 1–9 is an assist device 10, also called a water bottle assist device, which is used for inverting and mounting a filled replacement water bottle 12 within the recess 14 of a drinking water dispenser 16. The device 10 is a manually-operable and relatively simple device which supports the weight of a filled bottle 12 during the process of lifting, inverting, and positioning the neck 18 and upper end 20 of the bottle 12 within the recess 14. The device 10 can be manufactured out of wood, a durable, sturdy plastic material, or from coated metal.

Illustrated in FIGS. 1 and 4–7 is one example of the dispenser 16 which is set or placed upon a level surface 22, such as a factory floor, an office hallway, or a cafeteria floor. The dispenser 16 includes a first sidewall 24 against which the device 10 rests or leans and a second sidewall 26 opposite the first sidewall 24. The dispenser 16 also includes an upper end 28 wherein an inverted, cone-shaped, upwardly-opening water reservoir or recess 30 is located. A float valve 32 is disposed within the recess 30 and is in flow communication with a manually-operable outlet valve or tap 34. The neck 18 fits into and is received by structural elements (not shown) which permit the egress of water from the bottle 12 into the recess 30. The float valve 32 performs two essential functions: it seals off the neck 18 to prevent the bottle 12 from completely emptying and overflowing the recess 30; and as the water level within the recess 30 is lowered, the float valve 32 is drawn away from the structural components that receive the neck 18, thus allowing egress of water from the bottle 12 to the recess 30 for filling the recess 30. A circular flange, lip, or rim 36 may be located at the upper end of the recess 30 for supporting the circumferential shoulder 38 of the inverted bottle 12. The dispenser 16 terminates at upper end 20 with a top flat surface 40 which surrounds the upwardly-opening recess 30.

As shown in FIGS. 1–7, the device 10 includes a base member 42 for supporting the bottle 12 in an upright position adjacent to the first sidewall 24. The base member 42 includes four sidewalls 44 surrounding and enclosing a slight recess 46 which can be circular-shaped as in FIG. 2 or square-shaped as in FIG. 3. The shape of the recess 46 can be variable due to the fact that water bottle bottoms can be either circular-shaped or square-shaped. In fact, the recess 46 could be shaped to accommodate any configuration of bottle. The recess 46 need be only several inches deep to accommodate a bottom end 47 of the bottle 12. The base member 42 also includes a flat receiving surface 48 upon which the bottom end 47 rests. In order to prevent the bottle 12 from shifting during the process of mounting the bottle 12 into the recess 30, an insert member 50 can be placed within the sidewalls 44 and on the surface 48. The insert member 50 can be manufactured and cut from a hard, resistive styrofoam, for example. The insert member 50 is bounded by and held in place by the sidewalls 44. Thus, the recess 46 itself is formed out of the insert member 50, and the insert member 50 is held in place by the four upright sidewalls 44. It is also possible that the sidewalls 44 and the insert member 50 could be manufactured as one unit, especially if an injection molding process is used.

For the purpose of orientation, the sidewall 44 which rests or leans against the dispenser 16 may be designated the abutting or second side while the sidewall 44 opposite the second side may be designated the free or first side thereof. When the device 10 is in the non-use position, as shown in FIG. 1, the base member 42 is spaced from the floor surface 22 and is horizontally disposed with respect to the dispenser 16.

As illustrated in FIGS. 1, 2, and 4–7, the device 10 includes a means to position the base member 42 in a proper orientation with respect to the dispenser 16. The means to position the base member 42 includes an elongated support member 56 which is attached to the first side of the base member 42. The support member 56 includes an upper end 58 which defines the portion attached to the first side and an opposite lower second end 60 which rests upon the floor surface 22 when the device 10 is disposed in the non-use position. A plurality of spaced-apart through-holes are drilled through the body of member 56 for receiving fasteners more fully described hereinafter. In addition, instead of through-holes, an elongated groove can be cut through the body of member 56 to facilitate adjustable securement by an accompanying structural element hereinafter further explained. The through-holes shown in FIGS. 4–7 represent one particular choice of spacing and location; a variety of other locations and spacing of the through-holes could be selected and still perform the same function. As shown in FIGS. 1 and 3, it is the support member 56 and an accompanying structural element which spaces the base member 42 a given distance from the floor surface 22.

Because water bottles not only vary in shape but also in height, the device 10 also includes an extension member 62 to facilitate the proper positioning of the bottle 12 beside the dispenser 16. In order to properly mount the bottle 12 within the recess 46, the shoulder 38 must be adjacent to the upper edge 64 of the dispenser 16 where the level surface 40 and the first sidewall 24 meet. Because the height of water bottles varies, the support member 56 may not be able to raise the base member 42 away from the floor surface 22 so that the shoulder 38 of the bottle 12 is adjacent the upper edge 64 of the dispenser 16.

Therefore, the device 10 also includes the elongated extension member 62 illustrated in FIGS. 1, 2, and 4–7 and which is slidably secured to the support member 56 at the lower end 60 and is capable of selective linear adjustment relative to and thereagainst the support member 56 in order to raise the base member 42 along the first sidewall 24 so that the shoulder 38 of the bottle 12 is brought to a position adjacent to the upper edge 64 of the dispenser 16.

Figure 2:
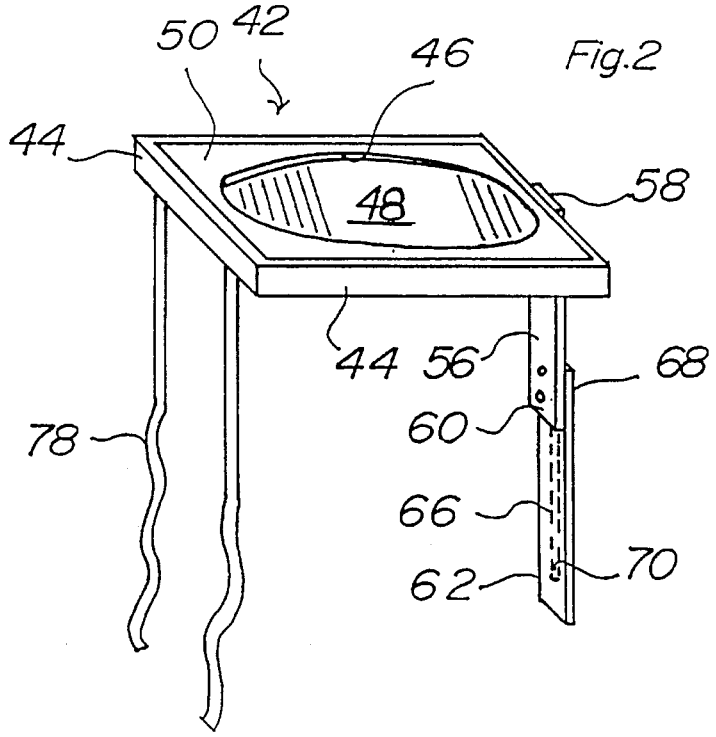
FIG. 2 is an isometric view of the assist device first shown in FIG. 1 illustrating the circular recess of the base member.
Figure 3:
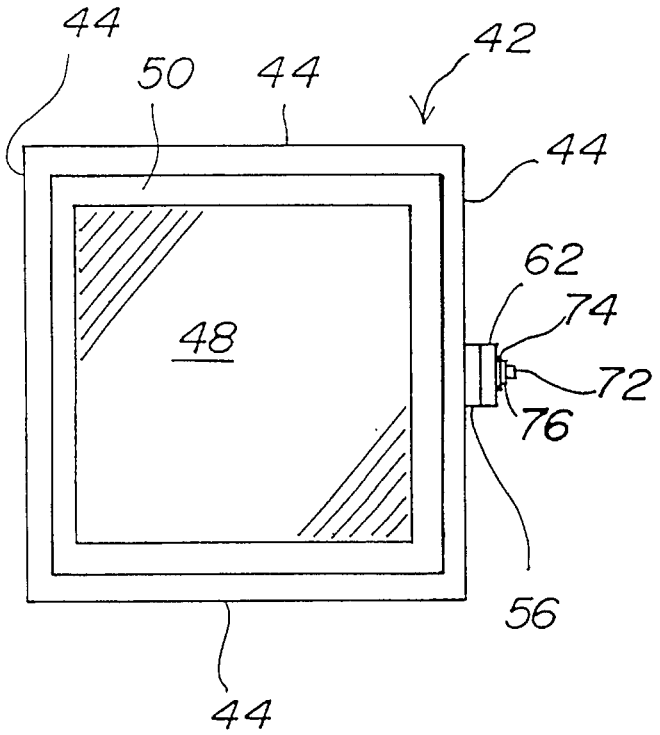
FIG. 3 is a top plan view of the base member first shown in FIG. 2 illustrating an alternative embodiment for the shape of the recess.

As shown in FIGS. 1–7, the extension member 62 includes a flat, sliding surface 66 which is contiguous to and slidably contacts the support member 56 during selective linear adjustment of the extension member 62. The extension member 62 also includes a flat, elongated facing surface 68 which is opposite the sliding surface 66 and an elongated groove 70 which is formed and cut completely through the extension member 62. A pair of fasteners 72, such as stove bolts or carriage bolts, are inserted through the groove 70 and into the corresponding through-holes at the lower end 60 of the support member 56. Flat washers 74 and nuts 76 are attached to the ends of the respective fasteners 72 and tightened down against the support member 56 as shown in FIGS. 1 and 2. By loosening the nuts 76, the extension member 62 can be slidably and linearly adjusted contiguous to the support member 56 along the entire length of the groove 70. There is no determinate length for either the support member 56 or the extension member 62: in the device 10, the support member 56 is generally twice as long as the extension member 62. Thus, by selectively adjusting the extension member 62, the distance the base member 42 is spaced from the floor surface 22 can be altered and this will allow for proper positioning of the shoulder 38 of the bottle 12 adjacent the upper edge 64 of the dispenser 16 when the bottle 12 is placed within the recess 46 of the base member 42.

Figure 8:
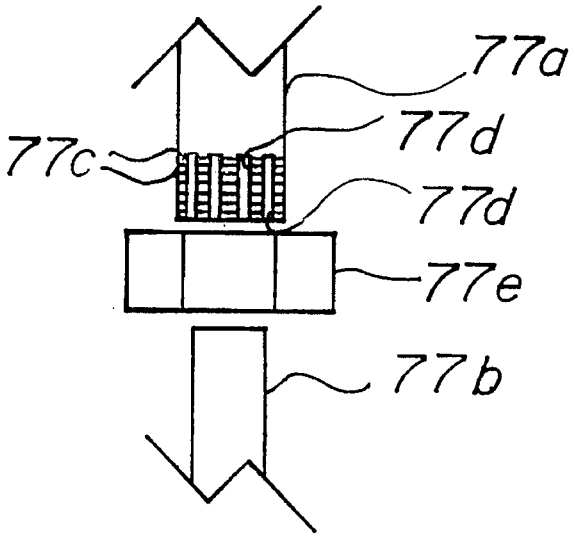
FIG. 8 is a front elevational view of the assist device illustrating an alternate embodiment for the support member and the extension member first shown in FIG. 1.
Figure 9:
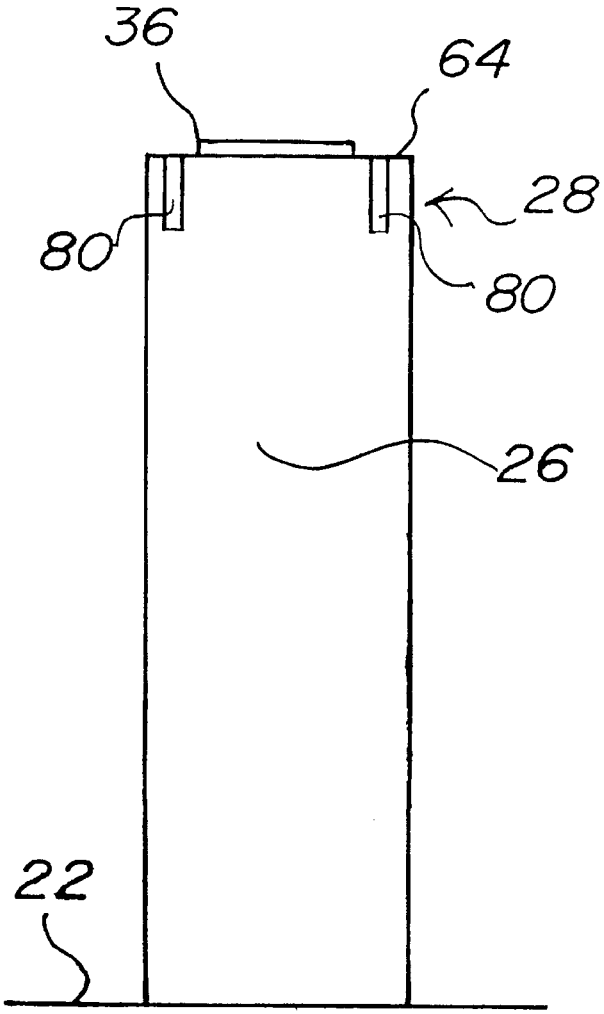
FIG. 9 is a side elevational view of the dispenser first shown in FIG. 1 illustrating the attachment strips.

As an alternative to members 56 and 62, the device 10 can employ support legs in the form of telescoping members cut to appropriate lengths and joined together by a spring-loaded ball, a detent, or a fitting which locks the members in place. For example, illustrated in FIG. 8 is an alternate embodiment which includes a larger diameter tubing 77*a* having generally the same length as the support member 56 and secured at its upper end to the sidewall 44. A smaller diameter tubing 77*b* having generally the same length as the extension member 62 will be disposed beneath the tubing 77*a* and will be capable of slidable linear reciprocable movement within the tubing 77*a*. On the lower end of the tubing 77*a* will be a series of compression threads 77*c* and compression slots 77*d*. A compression nut 77*e* will be threaded onto the threads 77*c* of the tubing 77*a*.

In order to locate the base member 42 the proper distance from the floor 22 so that the shoulder 38 of the bottle 12 is adjacent the edge 64 of the dispenser 16, the tubing 77*b* is simply slid inside tubing 77*a* until the base member 42 is spaced the appropriate distance from the floor 22. Turning the nut 77*e* clockwise causes tubing 77*a* to compress against tubing 77*b*, thus locking tubing 77*a* and 77*b* together at the coupling joint. The tubing 77*a* and 77*b* can be manufactured out of any suitable material, such as metal, pvc, or any other durable, rigid plastic.

In order to maintain the close proximity of the device 10 to the dispenser 16 during the mounting of the bottle 12, and also to maintain the contact between the upper edge 64 of the dispenser 16 and the shoulder 38 of the bottle 12, a retention means is utilized. The retention means maintains this proximity by preventing the device 10 from being pulled away from the dispenser 16 during the process of inverting and mounting the bottle 12 into the recess 30. The retention means includes a pair of elongated, spaced-apart attachment straps 78 as shown in FIGS. 1, 2, and 4–7, with each strap 78 being attached to the second side of the base member 42. The straps 78 are not tied around the dispenser 16 but, as shown in FIGS. 1 and 4–7, when the device 10 is disposed in the non-use position with the second side of the base member 42 resting or leaning against the first sidewall 24 of the dispenser 16, the straps 78 are strung upwardly along the first sidewall 24, then along the flat surface 40 of the dispenser 16, and then down along the second sidewall 26 of the dispenser 16 for a short distance. The straps 78 are contiguous to the dispenser 16 the full length of their extension.

In addition to the straps 78, the retention means could include pulleys or wires which would be attached to the base member 42 and would run along the dispenser 16. The wires would perform essentially the same function as the straps 78 in maintaining the proximity of the device 10 to the dispenser 16 during bottle changing. Furthermore, it is possible that some type of pulley system could be utilized as the retention means.

In order to secure the ends of the straps 78 to the second sidewall 26, an attachment means is utilized. The attachment means of the present invention includes a pair of spaced-apart attachment strips 80 removably secured to the upper end of the second sidewall 26 as shown in FIGS. 1, 4–7, and 9. The strips 80 have an adhesive backing which is pressed against the sidewalls 24 or 26 to secure the strips 80 thereto. The front or outwardly-facing portion of the strips 80 may be Velcro or some other adhesive material and the same would hold for the ends of the straps 78. Attaching the ends of the straps 78 to the respective strips 80 merely requires the individual to press the ends of the straps 78 against the strips 80. The elongated straps 78 and the strips 80 are all that are necessary to maintain the device 10 with the bottle 12 set within the recess 46 of the base member 42 in close proximity to the dispenser 16 during the process of lifting, pivoting, and inverting both the device 10 and the bottle 12. In addition, the ends of the straps 78 can be in the form of buckles or snaps which attach to a buckle or snap member mounted to the attachment strips 80.

Figure 4:
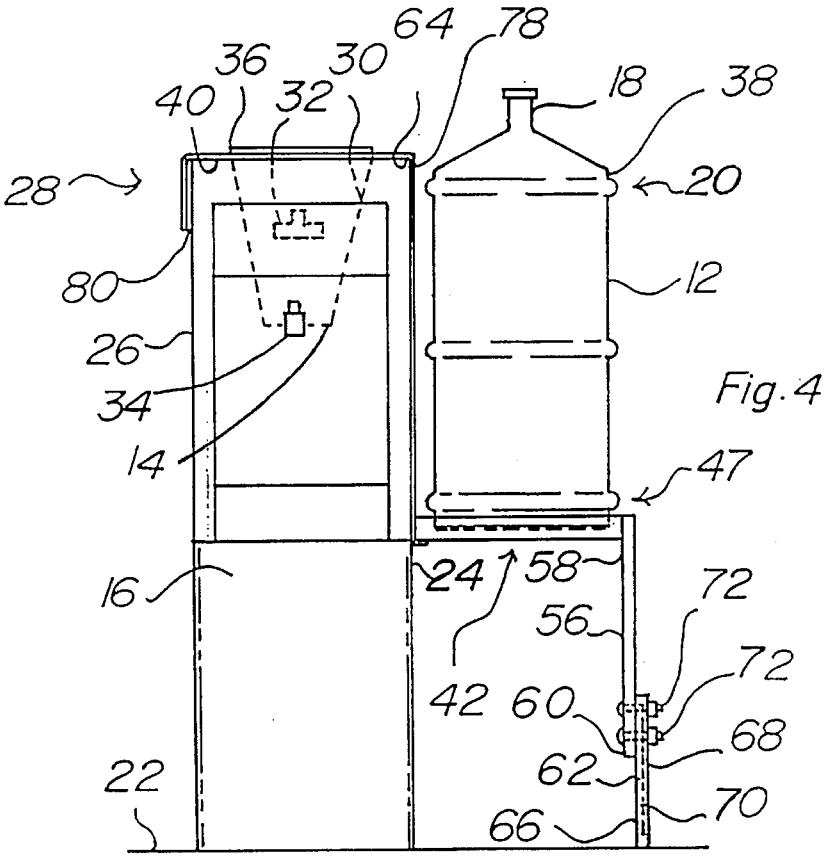
FIG. 4 is a side elevational view of the assist device first shown in FIG. 1 and supporting a filled replacement water bottle.

With reference to FIGS. 4–7, it is a fairly straightforward process to mount the bottle 12 atop the dispenser 16 using the assist device 10 of the present invention. FIG. 4 shows the device 10 in the non-use position with a bottle 12 already set within the recess 46 of the base member 42. In this figure, the extension member 62 has been slidably adjusted to give the maximum vertical extension of the support member 56 above the floor surface 22 so that the bottle 12 will have its shoulder 38 adjacent the upper edge 64 of the dispenser 16. The empty water bottle (not shown) has already been removed from the recess 30 of the dispenser 16 so all that remains is to mount the bottle 12 therein.

Figure 5:
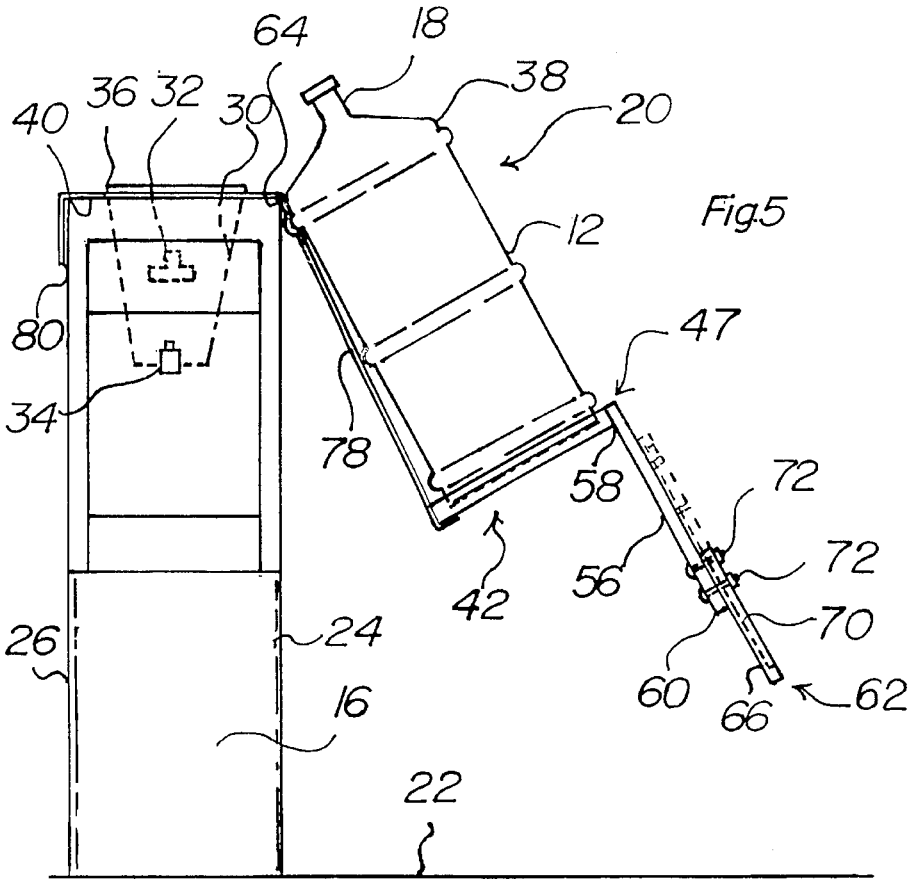
FIG. 5 is a side elevational view of the assist device supporting the replacement water bottle and shown in the initial process of inverting the assist device and the replacement water bottle.

FIG. 5 illustrates the position of the device 10 and the bottle 12 as the support member 56 is in the initial stage of being lifted up and away from the bottom of the dispenser 16. The individual would position himself or herself beside the device 10, firmly grip the support member 56, and simultaneously lift up and outward on the support member 56. As the individual lifts upward and outward on the support member 56, the shoulder 38 of the bottle 12 pivots on the upper edge 64 of the dispenser 16; the upper edge 64 acts essentially as the fulcrum for the device 10. As illustrated in FIG. 5, the straps 78 prevent the device 10 from being pulled away from the dispenser 16. If no structure was employed to keep the device 10 and the bottle 12 adjacent to the dispenser during the inversion process, the weight of the bottle 12 would cause the bottle 12 to slide down the upper edge 64 and along the first sidewall 24 of the dispenser 16, eventually crashing on the floor surface 22. In fact, the straps 78 are all that support the weight of the bottle 12 on the base member 42 when the device 10 is lifted off the floor, and, if the straps 78 were removed or not used, as soon as the individual started to lift and outwardly swing the support member 56, the unsupported weight of the bottle 12 could cause the bottle 12 to simply crash to the floor surface 22. It is also necessary that a portion of the straps 78 extend along the level surface 40 of the dispenser 16 as this surface 40 provides an upward force against the portions of the straps 78 extending thereon and counteracting the downward force exerted by the bottle 12 on the portion of the straps 78 which extend unsupported from the base member 42 to the upper edge 64 of the dispenser 16.

Figure 6:
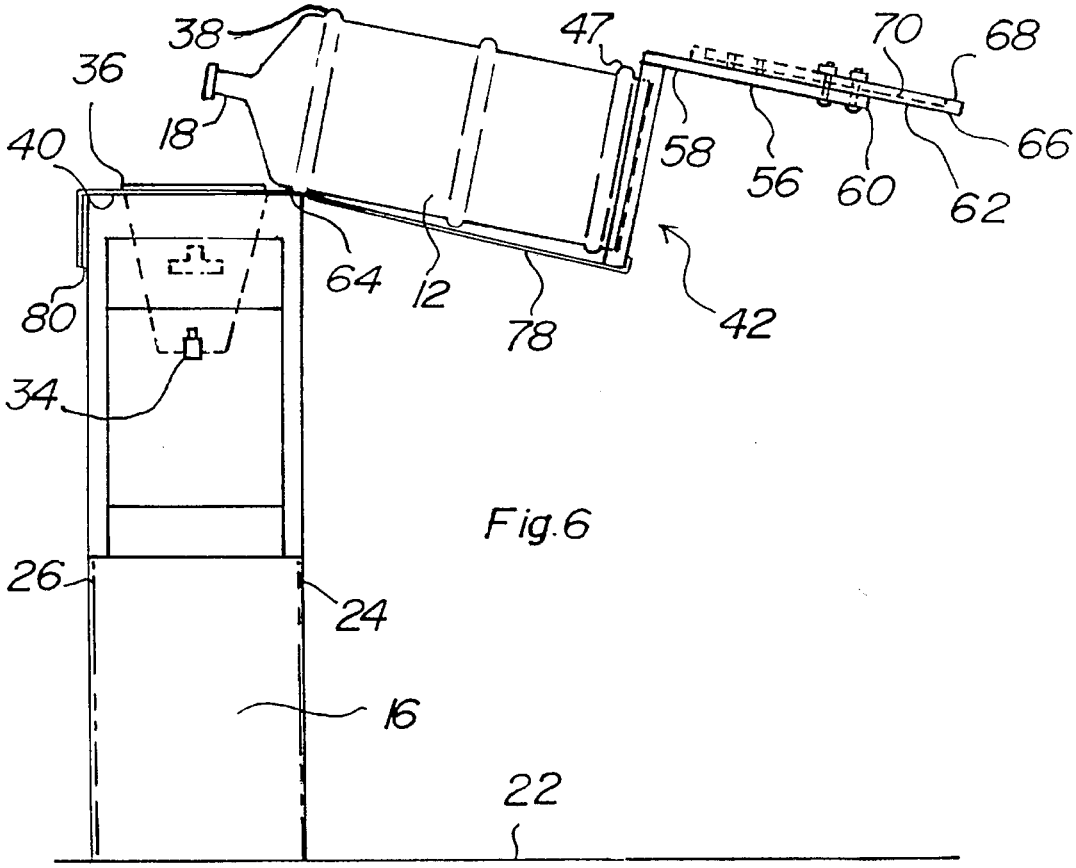
FIG. 6 is a side elevational view of the assist device supporting the replacement water bottle and shown midway through the process of inverting and mounting the bottle atop the dispenser.

FIG. 6 illustrates the device 10 and the bottle 12 in a position generally perpendicular to the dispenser 16. In this position, the bottom 47 of the bottle 12 is still maintained within the recess 46 while the straps 78 maintain the proximity of the device 10 to the dispenser 16 and the shoulder 38 of the bottle 12 is still pivoting against the upper edge 64 of the dispenser 16.

Figure 7:
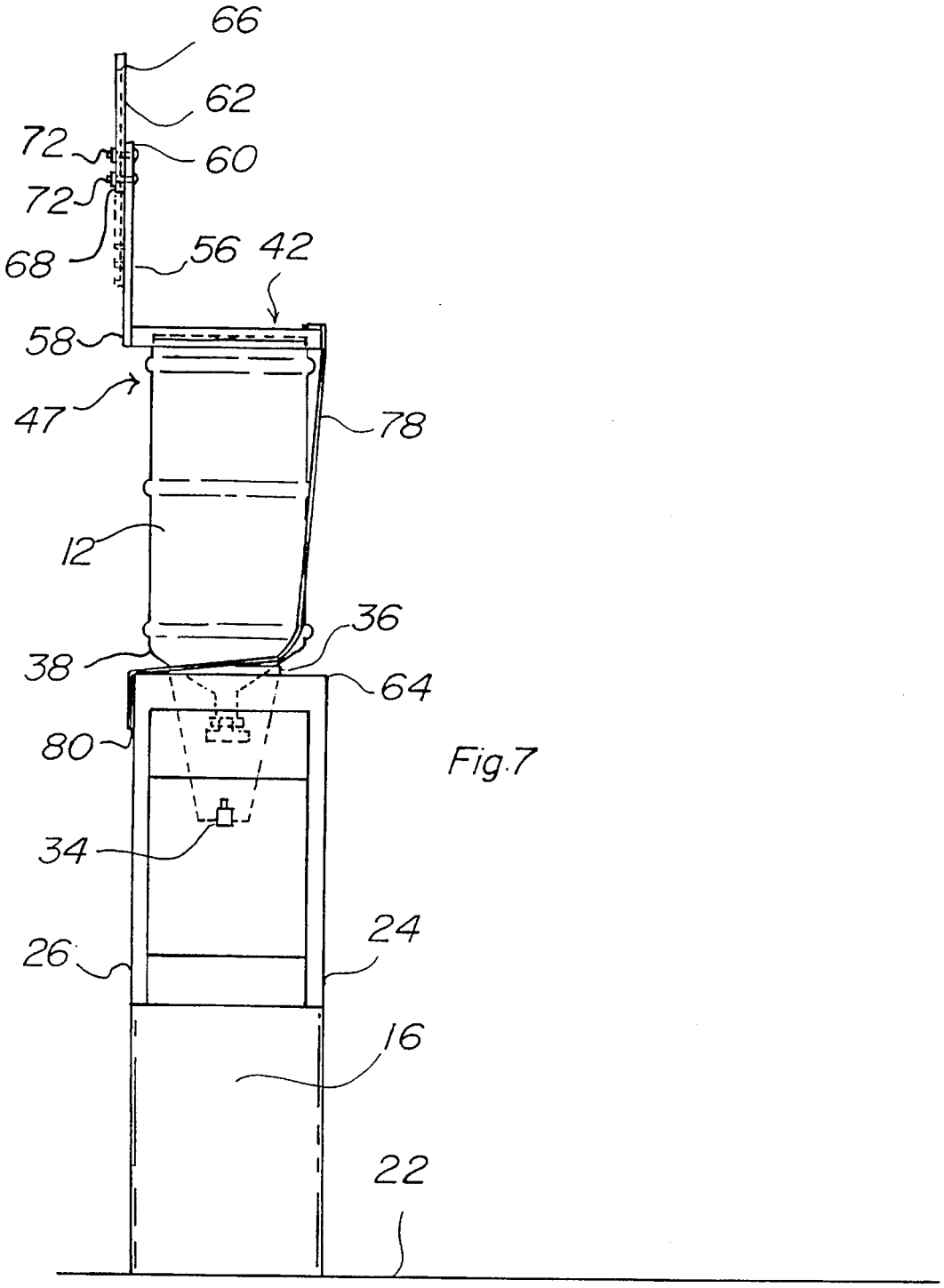
FIG. 7 is a side elevational view of the assist device and the replacement water bottle shown in the inverted position with the water bottle inverted and mounted into the recess of the dispenser.

Finally, FIG. 7 shows complete inversion of the device 10 and the bottle 12. In this figure the bottle 12 is shown in its inverted, upright position with the neck 18 completely within the recess 30 and the shoulder 38 supported by the rim 36. The device 10 is also in an inverted position with the bottom end 60 of the support member 56 and the bottom end of the extension member 62 pointing upwards to the roof or ceiling.

The entire process of gripping and simultaneously lifting and swinging the support member 56 outward and then continuing to swing the support member 56 in a half-circle until both the device 10 and the bottle 12 are in an inverted position atop the dispenser 16 only takes a few seconds. The process of mounting the bottle 12 within the recess 30 of the dispenser 16 is more easily accomplished if it is done in one continuous motion. Once the bottle 12 is inverted and securely mounted within the recess 30, the base member 42 can be lifted off of the bottle 12 and the device 10 can be simply returned to the non-use position whereby the second side of the base member 42 is leaning or resting against the sidewall 24 of the dispenser 16 as shown in FIG. 1. This completes the mounting of a filled replacement water bottle 12 atop the dispenser 16.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. For a drinking water dispenser of the type utilizing an inverted water bottle removably mounted on the upper end of the dispenser, an assist device for inverting the water bottle from an upright position to an inverted, dispensing position on the dispenser, comprising:

a base member having a recess into which a water bottle is temporarily set in an upright position;

an elongated support member for positioning the base member in a horizontal disposition against the dispenser;

retention means for maintaining the assist device and the water bottle in close proximity to the dispenser as the assist device inverts the water bottle from the upright position to the inverted, dispensing position;

an extension member attached to the support member and capable of selective linear adjustment relative to the support member in order to maintain the horizontal disposition of the support member relative to a floor surface;

the extension member further comprising a sliding sur-surface contiguous with the support member and which slidably contacts the support member during selective linear adjustment of the extension member; a flat elongated facing surface opposite the sliding surface;

the flat elongated facing surface further including an elongated groove;

an attachment means for securing the retention means to the dispenser; and the attachment means including a pair of attachment strips for securement to the dispenser in a spaced-apart relationship to that the retention means can be secured to each respective attachment strip.

2. The device of claim 1 wherein the recess of the base member is square-shaped.

3. The device of claim 1 wherein the recess of the base member is circular-shaped.

4. The device of claim 1 wherein the retention means includes a pair of elongated attachment straps attached to the base member and disposed along the dispenser for keeping the assist device and the water bottle in close proximity to the dispenser during the process of inverting the assist device and the water bottle.

* * * * *

UNITED STATES PATENT AND TRADEMARK OFFICE

CERTIFICATE OF CORRECTION

PATENT NO. : 5,586,692
DATED : December 24, 1996
INVENTOR(S) : Rodney C. Livengood It is certified that error appears in the above-indentified patent and that said Letters Patent is hereby corrected as shown below:

In Claim 1, column 8, line 36 of the Patent, please delete "to" after "tionship" and substitute --so-- in lieu thereof.

Signed and Sealed this

Fourth Day of March, 1997

Bruce Lehman

*Attest:*

BRUCE LEHMAN

*Attesting Officer*

*Commissioner of Patents and Trademarks*